US012557950B2

(12) United States Patent
Sörmark et al.

(10) Patent No.: US 12,557,950 B2
(45) Date of Patent: Feb. 24, 2026

(54) VACUUM CLEANER

(71) Applicant: Aktiebolaget Electrolux, Stockholm (SE)

(72) Inventors: Christoffer Sörmark, Stockholm (SE); Peter Mian, Stockholm (SE)

(73) Assignee: Aktiebolaget Electrolux, Stockholm (SE)

( * ) Notice: Subject to any disclaimer, the term of this patent is extended or adjusted under 35 U.S.C. 154(b) by 328 days.

(21) Appl. No.: 18/266,437

(22) PCT Filed: Dec. 17, 2020

(86) PCT No.: PCT/EP2020/086791
§ 371 (c)(1),
(2) Date: Jun. 9, 2023

(87) PCT Pub. No.: WO2022/128102
PCT Pub. Date: Jun. 23, 2022

(65) Prior Publication Data

US 2024/0041278 A1 Feb. 8, 2024

(51) Int. Cl.

| | |
|---|---|
| ***A47L 5/24*** | (2006.01) |
| ***A47L 9/22*** | (2006.01) |
| ***A47L 9/28*** | (2006.01) |

(52) U.S. Cl.
CPC *A47L 5/24* (2013.01); *A47L 9/22* (2013.01); *A47L 9/2842* (2013.01)

(58) Field of Classification Search
CPC ..... A47L 5/24; A47L 9/22; A47L 9/2842
See application file for complete search history.

(56) References Cited

U.S. PATENT DOCUMENTS

| | | | | |
|---|---|---|---|---|
| 2005/0055795 | A1 | 3/2005 | Zeiler et al. | |
| 2016/0174787 | A1 * | 6/2016 | Conrad | A47L 5/225 15/329 |

FOREIGN PATENT DOCUMENTS

| | | | | |
|---|---|---|---|---|
| DE | 948636 | C | 9/1956 | |
| EP | 1743563 | A2 | 1/2007 | |
| EP | 2351505 | A1 * | 8/2011 | A47L 9/00 |
| EP | 3318167 | A1 | 5/2018 | |
| JP | 2004036569 | | 2/2004 | |
| JP | 2007020765 | | 2/2007 | |
| JP | 2007020765 | A * | 2/2007 | A47L 9/2842 |

(Continued)

OTHER PUBLICATIONS

Examination Report dated Nov. 15, 2024 of corresponding Japanese Patent Application No. 2023-535336.

(Continued)

*Primary Examiner* — Marc Carlson
(74) *Attorney, Agent, or Firm* — Bradley Arant Boult Cummings LLP

(57) ABSTRACT

A vacuum cleaner comprising an elongated body having a nozzle end and a handle end, an air inlet arranged at the nozzle end, a handle arranged at the handle end, at least one air outlet arranged on the elongated body, and a dust separation unit arranged inside the elongated body. The vacuum cleaner further comprises a first motor/fan unit and a second motor/fan unit each arranged inside the elongated body. The first motor/fan unit and second motor/fan unit are arranged to operate in parallel to generate an airflow from the air inlet through the dust separation unit to the at least one air outlet.

20 Claims, 3 Drawing Sheets

(56) References Cited

FOREIGN PATENT DOCUMENTS

| | | | | |
|---|---|---|---|---|
| JP | 2007117134 | | | 5/2007 |
| JP | 2010104690 | | | 5/2010 |
| JP | 2017537743 | | | 12/2017 |
| JP | 2017537743 | A | * | 12/2017 |
| KR | 101304213 | B1 | | 9/2013 |

OTHER PUBLICATIONS

International Search Report and Written Opinion for International Application No. PCT/EP2020/086791, dated Aug. 24, 2021, 10 pages.
Notification of Reasons for Rejection dated Dec. 26, 2023 of Japanese Patent Application No. 2023-535336.

* cited by examiner

VACUUM CLEANER

This application is a U.S. National Phase application of PCT International Application No. PCT/EP2020/086791, filed Dec. 17, 2020, which is incorporated by reference herein.

TECHNICAL FIELD

The present disclosure relates to a vacuum cleaner comprising an elongated body having a nozzle end and a handle end, an air inlet arranged at the nozzle end, and a handle arranged at the handle end. Such vacuum cleaners are sometimes referred to as stick-type vacuum cleaners.

BACKGROUND

A vacuum cleaner is an apparatus that uses a motor/fan unit to create a partial vacuum in order to obtain an air flow for sucking up dust and dirt from surfaces, such as floors, carpets, furniture, curtains, and the like. The motor/fan unit usually comprises a centrifugal fan and an electric motor configured to power, i.e. rotate, the centrifugal fan.

Various types of vacuum cleaners exist, among them canister vacuum cleaners, robotic vacuum cleaners, central vacuum cleaners, and stick-type vacuum cleaners. A stick-type vacuum cleaner comprises an elongated body having a nozzle arranged at one end and a handle arranged at a second end. Stick-type vacuum cleaners have become increasingly popular partly because they are simple to use for example when wanting to clean smaller areas. Moreover, stick-type vacuum cleaners occupy little space when not in use and can for example be attached to a wall mounted bracket when not in use.

However, the elongated shape of a stick type vacuum cleaner puts demands on the design of the vacuum cleaner. It is an advantage if the vacuum cleaner has a slim design, but it can be difficult to achieve due to the components needed inside the vacuum cleaner. Moreover, some general problems and requirements exist when designing vacuum cleaners. One example is cleaning efficiency. Users of vacuum cleaners expect a high cleaning efficiency to achieve a good cleaning result with little effort. The cleaning efficiency partly depends on the airflow rate, an in turn, the airflow rate depends on the magnitude of the partial vacuum created by the motor/fan unit.

Another important requirement of vacuum cleaners is energy efficiency. The energy efficiency of a vacuum cleaner is an important aspect due to environmental concerns. Moreover, in battery powered vacuum cleaners, an improvement in energy efficiency results in a prolonged available operational time, given a certain energy storage capacity of the batteries of the vacuum cleaner. Likewise, an improvement in energy efficiency of a battery powered vacuum cleaner allows batteries of the vacuum cleaner to be smaller in size, weight, and capacity while maintaining a certain available operational time of the vacuum cleaner.

In a vacuum cleaner, the energy efficiency can be defined as the ratio between the useful output in the form of suction power and the input of electrical energy. A problem associated with vacuum cleaners is that the energy efficiency of the vacuum cleaner drops significantly at higher airflow levels of the motor/fan unit. Likewise, the energy efficiency of the vacuum cleaner drops significantly at lower airflow levels of the motor/fan unit. That is, when the motor/fan unit of a vacuum cleaner is operated at higher airflow levels, as well as at lower airflow levels, the ratio between the useful output in the form of suction power and the input of electrical energy drops significantly. In other words, many motor/fan units have a narrow operational range in which the vacuum cleaner can be operated in an efficient manner.

SUMMARY

It is an object of the present invention to overcome, or at least alleviate, at least some of the above-mentioned problems and drawbacks.

According to an aspect of the invention, the object is achieved by a vacuum cleaner comprising an elongated body having a nozzle end and a handle end, an air inlet arranged at the nozzle end, a handle arranged at the handle end, and at least one air outlet arranged on the elongated body. The vacuum cleaner further comprises a dust separation unit arranged inside the elongated body, and a first and a second motor/fan unit each arranged inside the elongated body. The first and second motor/fan units are arranged to operate in parallel to generate an airflow from the air inlet through the dust separation unit to the at least one air outlet.

Since the vacuum cleaner comprises two motor/fan units arranged to operate in parallel to generate an airflow from the air inlet through the dust separation unit, a vacuum cleaner is provided having conditions for a significantly widened operational range in which the vacuum cleaner can be operated in an efficient manner. This is because the airflows and partial vacuums of the motor/fan units are combined due to the parallel arrangement thereof. Moreover, a vacuum cleaner is provided having conditions for generating higher airflow levels through the air inlet which provides conditions for an improved cleaning efficiency.

Furthermore, since the vacuum cleaner comprises two motor/fan units arranged to operate in parallel, a vacuum cleaner is provided having conditions for generating high pressure difference levels also in situations of high pressure drops in the vacuum cleaner, such as for example when the dust separation unit and/or a filter of the vacuum cleaner is/are partially clogged. Thus, as a result of these features, conditions are provided for obtaining a high cleaning efficiency also if the dust separation unit and/or a filter of the vacuum cleaner is/are partially clogged. Moreover, since the vacuum cleaner comprises two motor/fan units having conditions for generating high pressure difference levels, conditions are provided for using thicker and/or denser noise attenuating materials in channels and ducts of the vacuum cleaner and still be able to generate high air flow levels through the air inlet of the vacuum cleaner.

In addition, since the vacuum cleaner comprises two motor/fan units each arranged in the elongated body, a vacuum cleaner is provided having conditions for a slim design. That is, since the vacuum cleaner comprises two motor/fan units, motor/fan units being smaller in size and weight can be used as compared to vacuum cleaners comprising one motor/fan unit. Moreover, since the vacuum cleaner comprises two motor/fan units, a great freedom in the positioning of the first and second motor/fan units is provided which provides conditions for a slimmer design as well as an improved weight distribution of the components of the vacuum cleaner.

Accordingly, a vacuum cleaner is provided overcoming, or at least alleviating, at least some of the above-mentioned problems and drawbacks. As a result, the above-mentioned object is achieved.

Optionally, the dust separation unit comprises a cyclone separator. Since the vacuum cleaner comprises two motor/fan units arranged to operate in parallel to generate an airflow through the cyclone separator, the dust separation efficiency of the cyclone separator can be improved. This because the use of two motor/fan units operating in parallel provides conditions for significantly increased airflow levels as compared to the use of one motor/fan unit and the dust separation efficiency of a cyclone separator is dependent on the airflow rate through the cyclone separator.

Optionally, the first and second motor/fan units are differently configured. According to these embodiments, the second motor/fan unit may be differently configured than the first motor/fan unit regarding structural aspects and/or regarding efficient working point, i.e. the operational point at which the motor/fan unit operates most efficiently. The structural aspects may include one or more of type of motor, size of motor, type of fan, and size of fan. Since according to these embodiments, the first and second motor/fan units are differently configured, and due to the parallel arrangement of the first and second motor/fan units, a vacuum cleaner is provided having conditions for a further widened operational range in which the vacuum cleaner can be operated in an efficient manner.

Optionally, each of the first and second motor/fan unit comprises a fan and an electric motor configured to power the fan, and wherein the first and second motor/fan unit are differently configured regarding type and/or size of the electric motor. Thereby, a vacuum cleaner is provided having conditions for a further widened operational range in which the vacuum cleaner can be operated in an efficient manner.

Optionally, each of the first and second motor/fan unit comprises a fan and an electric motor configured to power the fan, and wherein the first and second motor/fan unit are differently configured regarding type and/or size of the fan. Thereby, a vacuum cleaner is provided having conditions for a further widened operational range in which the vacuum cleaner can be operated in an efficient manner.

Optionally, at least one of the first and second motor/fan unit comprises a fan and a brushless electric motor configured to power the fan. Thereby, a vacuum cleaner is provided having conditions for a further widened operational range in which the vacuum cleaner can be operated in an efficient manner. This is because a motor/fan unit comprising a brushless motor has conditions for high rotational speeds to generate high vacuum levels and high airflow levels. Moreover, a vacuum cleaner is provided having conditions for a slimmer design and lower weight because a brushless electric motor can be designed to have a small size and weight and yet be able to operate at high power levels.

Optionally, each of the first and second motor/fan unit comprises a fan and a brushless electric motor configured to power the fan. Thereby, a vacuum cleaner is provided having conditions for a further widened operational range in which the vacuum cleaner can be operated in an efficient manner. This is because a motor/fan unit comprising a brushless motor has conditions for high rotational speeds to generate high vacuum levels and high airflow levels. Moreover, a vacuum cleaner is provided having conditions for a slimmer design and lower weight because a brushless electric motor can be designed to have a small size and weight and yet be able to operate at high power levels.

Optionally, the vacuum cleaner comprises a control arrangement configured to control operation of the first and second motor/fan unit, and wherein the control arrangement is configured to operate the first and second motor/fan unit in a mode in which the first and second motor/fan unit are operated at different power levels. Thereby, conditions are provided for further widening the operational range in which the vacuum cleaner can be operated in an efficient manner in order to provide high cleaning efficiency while consuming a low amount of electrical energy.

Optionally, the second motor/fan unit is arranged at a greater distance from the nozzle end than the first motor/fan unit. Thereby, a vacuum cleaner is provided having conditions for a slimmer design and better weight distribution of the components of the vacuum cleaner.

Optionally, the first and second motor/fan unit are arranged inside the elongated body such that a central elongation axis of the elongated body extends through each of the first and second motor/fan unit. Thereby, a vacuum cleaner is provided having conditions for a slimmer design and better weight distribution of the components of the vacuum cleaner. Moreover, since the first and second motor/fan unit are arranged inside the elongated body such that a central elongation axis of the elongated body extends through each of the first and second motor/fan unit, an outer shell of the vacuum cleaner can be designed to have a smaller circumference than if the first and second motor/fan units were arranged side by side inside the elongated body.

Optionally, the second motor/fan unit comprises a rotation axis being substantially parallel to a rotation axis of the first motor/fan unit. Thereby, a vacuum cleaner is provided having conditions for a slimmer design and better weight distribution of the components of the vacuum cleaner.

Optionally, the rotation axes of the first and second motor/fan units are substantially parallel to the central elongation axis of the elongated body. Thereby, a vacuum cleaner is provided having conditions for a further slimmer design and better weight distribution of the components of the vacuum cleaner.

Optionally, the vacuum cleaner comprises a battery assembly configured to supply electricity to the first and second motor/fan unit. Thereby, a user-friendly vacuum cleaner is provided. Moreover, due to the fact that the vacuum cleaner has conditions for operating in an efficient manner in a wide operational range, conditions are provided for arranging the vacuum cleaner with batteries smaller in size and capacity while maintaining a sufficient available operational time of the vacuum cleaner and/or increasing the available operational time of the vacuum cleaner.

Optionally, the vacuum cleaner comprises a duct assembly configured to conduct air from the air inlet through the dust separation unit to the at least one air outlet, and wherein the duct assembly comprises a section in thermal communication with the battery assembly. Thereby, a vacuum cleaner is provided in which the battery assembly can be cooled in a further efficient manner. This is because the two motor/fan units operating in parallel have a greater ability to generate high airflow levels as compared to one motor/fan unit which in turn provides a greater cooling efficiency of the battery assembly.

Optionally, the section is arranged downstream of the respective first and second motor/fan units. Thereby, a vacuum cleaner is provided having conditions for a slim design and better weight distribution of the components of the vacuum cleaner.

Optionally, walls of the duct assembly are provided with a noise attenuating material. Thereby, noise generated during operation of the vacuum cleaner can be attenuated in an efficient manner. Moreover, since the vacuum cleaner comprises two motor/fan units having conditions for generating high pressure difference levels, conditions are provided for using thicker and/or denser noise attenuating materials on walls of the duct assembly and still be able to generate high air flow levels through the air inlet of the vacuum cleaner. The noise attenuating material may for example comprise a foam material.

Optionally, the vacuum cleaner comprises two separate air outlets arranged on the elongated body. Thereby, a vacuum cleaner is provided having conditions for operating in an efficient manner due to a low common pressure drop through the two separate air outlets. Moreover, a more user-friendly vacuum cleaner can be provided because of a lower air flow rate through the respective air outlets as compared to the use of one air outlet.

Optionally, the vacuum cleaner is configured for floor cleaning. Thereby, vacuum cleaner for floor cleaning is provided having conditions for a significantly widened operational range in which the vacuum cleaner can be operated in an efficient manner. Moreover, a vacuum cleaner for floor cleaning is provided having conditions for generating higher airflow levels through the air inlet which provides conditions for an improved cleaning efficiency.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
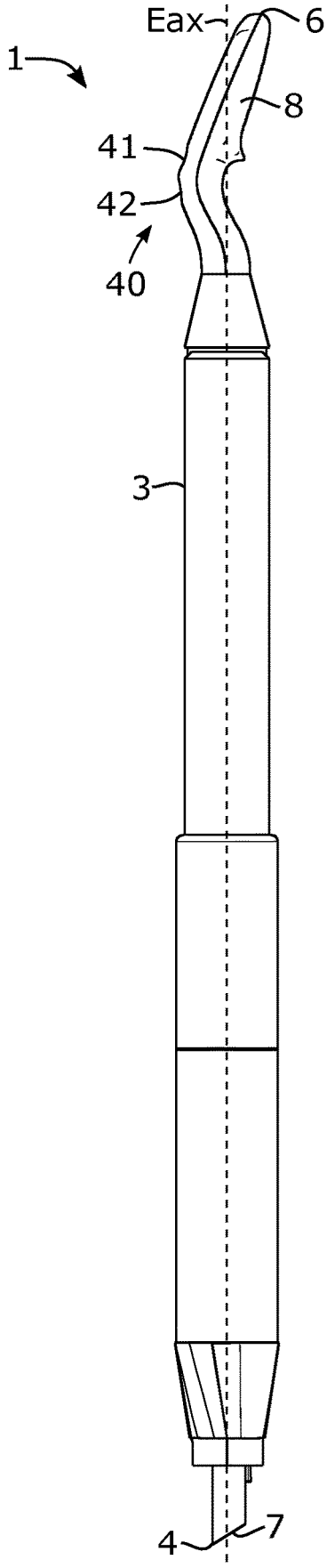
FIG. 1 illustrates a side view of a vacuum cleaner according to some embodiments of the present disclosure.

FIG. 1 illustrates a side view of a vacuum cleaner 1 according to some embodiments of the present disclosure. The vacuum cleaner 1 is a so called stick-type vacuum cleaner 1 comprising an elongated body 3 having a nozzle end 4 and a handle end 6, an air inlet 7 arranged at the nozzle end 4, a handle 8 arranged at the handle end 6. According to the illustrated embodiments, the vacuum cleaner 1 is configured for floor cleaning, preferably in homes, offices, and the like. The vacuum cleaner 1 has a central elongation axis Eax extending through the nozzle end 4 and the handle end 6 of the elongated body 3. The elongated body 3 is elongated in the sense that it has considerable larger dimensions along the central elongation axis Eax than in directions perpendicular to the central elongation axis Eax.

The handle 8 is configured to be gripped by a hand of a user during operation of the vacuum cleaner 1. The vacuum cleaner 1 may be operated using one hand only. The vacuum cleaner 1 may comprise a nozzle for attachment to the nozzle end 4 such that the air inlet 7 of the vacuum cleaner 1 is fluidly connected to one or more air inlets of the nozzle. The vacuum cleaner 1 may be operated by moving the nozzle over a surface so as to clean the surface. The nozzle is not illustrated in FIG. 1 for reasons of brevity and clarity. The vacuum cleaner 1 may also be operated without the nozzle being attached to the nozzle end 4 by moving the nozzle end 4 over a surface to be cleaned.

Figure 2:
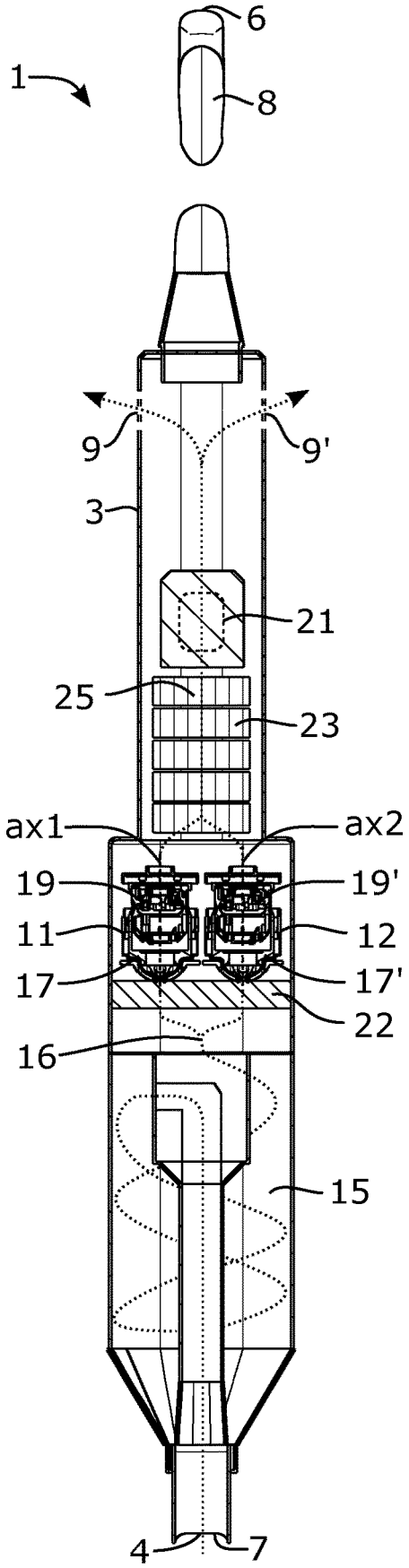
FIG. 2 illustrates a cross section of the vacuum cleaner illustrated in FIG. 1.

FIG. 2 illustrates a cross section of the vacuum cleaner 1 illustrated in FIG. 1. In FIG. 2, the cross section is made through the central elongation axis Eax illustrated in FIG. 1 in a direction coinciding with the viewing direction of FIG. 1. As can be seen in FIG. 2, according to the illustrated embodiments, the vacuum cleaner 1 comprises two separate air outlets 9, 9' arranged on the elongated body 3. However, according to further embodiments, the vacuum cleaner 1 may comprise one air outlet or more than two air outlets 9, 9'. The vacuum cleaner 1 further comprises a dust separation unit 15 arranged inside the elongated body 3. According to the illustrated embodiments, the dust separation unit 15 comprises a cyclone separator. As an alternative, or in addition, the dust separation unit 15 may comprise another type of dust separation unit, such as a dust bag, or the like. As can be seen in FIG. 2, according to embodiments herein, the vacuum cleaner 1 comprises a first motor/fan unit 11 and a second motor/fan unit 12 each arranged inside the elongated body 3. Each of the first and second motor/fan unit 11, 12 comprises a fan 17, 17' and an electric motor 19, 19' configured to power the fan 17, 17'.

The vacuum cleaner 1 comprises a duct assembly 16 configured to conduct air from the air inlet 7 through the dust separation unit 15 to the at least one air outlet 9, 9'. As can be seen in FIG. 2, the first and second motor/fan units 11, 12 are arranged in parallel relative to each other in the duct assembly 16. The first and second motor/fan units 11, 12 are thus arranged to operate in parallel to generate an airflow from the air inlet 7 through the dust separation unit 15 to the at least one air outlet 9, 9'.

Due to these features, a vacuum cleaner 1 is provided having conditions for a significantly widened operational range in which the vacuum cleaner 1 can be operated in an efficient manner, as is further explained herein. This is because the airflows and partial vacuums of the first and second motor/fan units 11, 12 are combined due to the parallel arrangement of the first and second motor/fan units 11, 12 in the duct assembly 16. Moreover, a vacuum cleaner 1 is provided having conditions for generating higher airflow levels through the air inlet 7 which provides conditions for an improved cleaning efficiency.

Furthermore, since the vacuum cleaner 1 comprises two motor/fan units 11, 12 arranged to operate in parallel, a vacuum cleaner 1 is provided having conditions for generating high pressure difference levels also in situations of high pressure drops in the vacuum cleaner 1, such as for example when the dust separation unit 15 and/or a filter 22 of the vacuum cleaner 1 is/are partially clogged. Thus, as a result of these features, conditions are provided for a high cleaning efficiency also if the dust separation unit 15 and/or a filter 22 of the vacuum cleaner 1 is/are partially clogged.

The feature that the first and second motor/fan units 11, 12 are arranged to operate in parallel to generate an airflow from the air inlet 7 through the dust separation unit 15 means that each of the first and second motor/fan units 11, 12 is arranged to pump air through the dust separation unit 15 via a flow path which does not pass through the other motor/fan unit 11, 12. Likewise, the feature that the first and second motor/fan units 11, 12 are arranged in parallel relative to each other in the duct assembly 16 means that each of the first and second motor/fan units 11, 12 is arranged to pump air through the dust separation unit 15 via a flow path which does not pass through the other motor/fan unit 11, 12. Moreover, each of the first and second motor/fan units 11, 12 may have an air inlet fluidly connected to the dust separation unit 15 via a flow path which does not pass through the other motor/fan unit 11, 12.

Since the vacuum cleaner 1 according to the illustrated embodiments comprises two motor/fan units 11, 12 arranged to operate in parallel to generate an airflow through a dust separation unit 15 comprising a cyclone separator, the dust separation efficiency of the cyclone separator can be improved. This is because the arrangement with two motor/fan units 11, 12 operating in parallel is capable of generating higher airflow rates through the cyclone separator in an efficient manner as compared to the use of one motor/fan unit. According to the illustrated embodiments, the vacuum cleaner 1 comprises a filter 22 arranged between the dust separation unit 15 and the first and second motor/fan units 11, 12. The filter 22 is configured to further separate fine particles from air flowing towards the first and second motor/fan units 11, 12. The filter 22 may comprise a semi-permeable material, such as a foam and/or a textile material.

According to some embodiments, the first and second motor/fan units 11, 12 are differently configured. The first and second motor/fan unit 11, 12 may be differently configured regarding type and/or size of the electric motor 19, 19'. As an alternative, or in addition, the first and second motor/fan unit 11, 12 may be differently configured regarding type and/or size of the fan 17, 17'. As a further alternative, or in addition, the second motor/fan unit 9' may be differently configured than the first motor/fan unit 9 regarding working point. The working points of the first and second first motor/fan unit 9, 9' may be defined as the airflow rate generated at the highest ratio between suction power and inputted electrical energy. The suction power may be defined as the flowrate times pressure difference generated.

According to the illustrated embodiments, each of the first and second motor/fan unit 11, 12 comprises a brushless electric motor 19, 19' configured to power the fan 17, 17' of the motor/fan unit 11, 12. According to further embodiments, at least one of the first and second motor/fan unit 11, 12 comprises a brushless electric motor 19, 19' configured to power the fan 17, 17' of the motor/fan unit 11, 12. Due to these features, a vacuum cleaner 1 is provided having conditions for a further widened operational range in which the vacuum cleaner 1 can be operated in an efficient manner. Moreover, a vacuum cleaner 1 is provided having conditions for generating high airflow rates at the air inlet 7. This is because a motor/fan unit 11, 12 comprising a brushless motor usually has the ability to generate high vacuum levels through high rotational speeds.

The vacuum cleaner 1 comprises a control arrangement 21. The control unit 21 is configured to control operation of the first and second motor/fan unit 11, 12. Moreover, according to the illustrated embodiments, the vacuum cleaner 1 comprises a battery assembly 23. The battery assembly 23 may comprise a number of rechargeable battery cells. The battery assembly 23 is configured to supply electricity to each of the first and second motor/fan unit 11, 12 by an amount controlled by the control unit 21. Thus, according to the illustrated embodiments, the first and second motor/fan unit 11, 12 are powered by a common power supply, i.e. the battery assembly 23 according to the illustrated embodiments.

According to some embodiments, the control arrangement 21 is configured to operate the first and second motor/fan unit 11, 12 in a mode in which the first and second motor/fan unit 11, 12 are operated at different power levels. Thereby, conditions are provided for further widening the operational range in which the vacuum cleaner 1 can be operated in an efficient manner in order to provide high cleaning efficiency while consuming a low amount of electrical energy.

As best seen in FIG. 1, according to the illustrated embodiments, the vacuum cleaner 1 comprises a user interface 40 comprising two buttons 41, 42. According to further embodiments, the user interface 40 may comprise one or more other types of input devices, such as a switch, a knob, a touch sensitive screen, or the like. The buttons 41, 42 of the user interface 40 is operably connected to the control unit 21 for allowing a user to activate and deactivate operation of the first and second motor/fan unit 11, 12. Moreover, the user interface 40 of the vacuum cleaner 1 may allow a user to select an operational mode of the vacuum cleaner 1, wherein the operational modes of the vacuum cleaner 1 may comprise one or more of a mode in which the first and second motor/fan unit 11, 12 are simultaneously operated at the same power level, a mode in which the first and second motor/fan unit 11, 12 are simultaneously operated at different power levels, and a mode in which only one of the first and second motor/fan unit 11, 12 is operated.

The vacuum cleaner 1 may comprise a one way valve, or other type of arrangement in the duct assembly 16, for preventing a reverse flow of air over the inactive motor/fan unit 11, 12 when the vacuum cleaner 1 is operating in an operational mode in which only one of the first and second motor/fan unit 11, 12 is operated.

As indicated in FIG. 2, according to the illustrated embodiments, the duct assembly 16 comprises a section 25 in thermal communication with the battery assembly 23. According to the illustrated embodiments, the section 25 is in thermal communication with the battery assembly 23 by extending past the battery assembly 23. Moreover, as seen in FIG. 2, according to the illustrated embodiments, the section 25 is arranged downstream of the respective first and second motor/fan units 11, 12. In this manner, an efficient cooling of the battery assembly 23 is provided during operation of the vacuum cleaner 1. Moreover, according to the illustrated embodiments, the flow path between the first and second motor/fan units 11, 12 and the at least one air outlet 9, 9' extend past the control unit 21. In this manner, an efficient cooling of the control unit 21 is provided during operation of the vacuum cleaner 1.

In FIG. 2, a respective rotation axis ax1, ax2 of the first and second motor/fan units 11, 12 are indicated. A rotor of the electric motor 19 of the first motor/fan unit 11 and the fan 17 of the first motor/fan unit 11 are configured to rotate around the rotation axis ax1 of the first motor/fan unit 11 during operation of the first motor/fan unit 11. Likewise, a rotor of the electric motor 19' of the second motor/fan unit 12 and the fan 17' of the second motor/fan unit 12 are configured to rotate around the rotation axis ax2 of the second motor/fan unit 12 during operation of the second motor/fan unit 12. According to the embodiments illustrated in FIG. 2, the rotation axis ax2 of the second motor/fan unit 12 is parallel to the rotation axis ax1 of the first motor/fan unit 11. According to further embodiments, the rotation axis ax2 of the second motor/fan unit 12 may be substantially parallel to the rotation axis ax1 of the first motor/fan unit 11.

The feature that the rotation axis ax2 of the second motor/fan unit 12 is substantially parallel to the rotation axis ax1 of the first motor/fan unit 11 may encompass that the angle between the rotation axis ax1 of the first motor/fan unit 11 and the rotation axis ax2 of the second motor/fan unit 12 is less than 10 degrees, or less than 5 degrees.

According to the illustrated embodiments, the rotation axes ax1, ax2 the first and second motor/fan units 11, 12 are parallel to the central elongation axis Eax of the elongated body 3. According to further embodiments, the rotation axes ax1, ax2 the first and second motor/fan units 11, 12 may be substantially parallel to the central elongation axis Eax of the elongated body 3. The feature that the rotation axes ax1, ax2 the first and second motor/fan units 11, 12 is substantially parallel to the central elongation axis Eax may encompass that the angle between the respective rotation axis ax1, ax2 and the central elongation axis Eax of the elongated body 3 is less than 10 degrees, or less than 5 degrees. Due to these features, conditions are provided for a slim design of the elongated body 3 due to conditions for a space efficient routing of ducts forming the duct assembly 16 of the vacuum cleaner 1.

According to the embodiments illustrated in FIG. 1 and FIG. 2, the first and second motor/fan units 11, 12 are arranged at the same distance from the nozzle end 4. In other words, according to the embodiments illustrated in FIG. 1 and FIG. 2, the first and second motor/fan units 11, 12 are arranged side by side in a plane perpendicular to the central elongation axis Eax of the elongated body 3.

Figure 3:
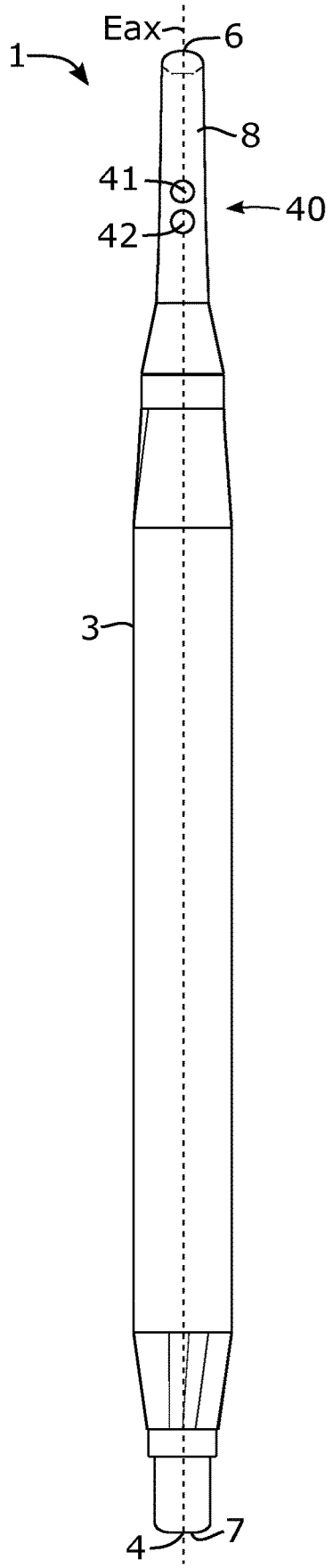
FIG. 3 illustrates a front view of a vacuum cleaner according to some further embodiments of the present disclosure.

FIG. 3 illustrates a front view of a vacuum cleaner 1 according to some further embodiments of the present disclosure. The vacuum cleaner 1 according to the embodiments illustrated in FIG. 3 may comprise the same features, functions, and advantages as the vacuum cleaner 1 explained with reference to FIG. 1 and FIG. 2.

The vacuum cleaner 1 is a so called stick-type vacuum cleaner 1 comprising an elongated body 3 having a nozzle end 4 and a handle end 6, an air inlet 7 arranged at the nozzle end 4, a handle 8 arranged at the handle end 6. The vacuum cleaner 1 has a central elongation axis Eax extending through the nozzle end 4 and the handle end 6 of the elongated body 3. The elongated body 3 is elongated in the sense that it has considerable larger dimensions along the central elongation axis Eax than in directions perpendicular to the central elongation axis Eax.

The handle 8 is configured to be gripped by a hand of a user during operation of the vacuum cleaner 1. The vacuum cleaner 1 may be operated using one hand only. The vacuum cleaner 1 may comprise a nozzle for attachment to the nozzle end 4 such that the air inlet 7 of the vacuum cleaner 1 is fluidly connected to one or more air inlets of the nozzle. The vacuum cleaner 1 may be operated by moving the nozzle over a surface so as to clean the surface. The nozzle is not illustrated in FIG. 1 for reasons of brevity and clarity. The vacuum cleaner 1 may also be operated without the nozzle being attached to the nozzle end 4 by moving the nozzle end 4 over a surface to be cleaned.

Figure 4:
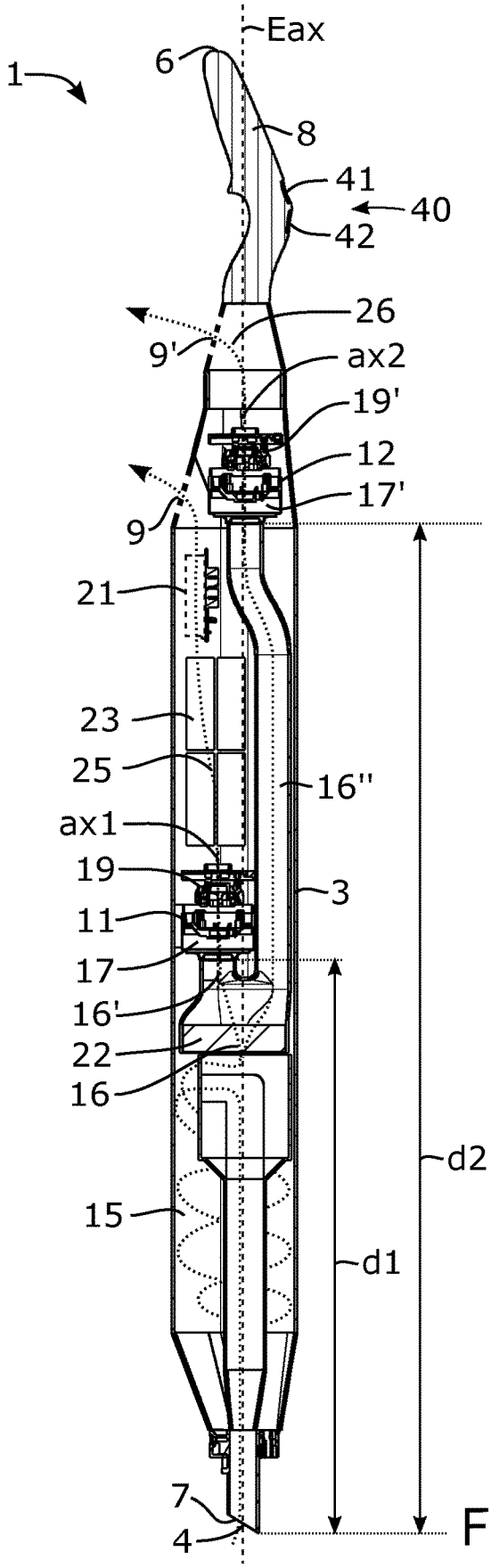
FIG. 4 illustrates a cross section of the vacuum cleaner illustrated in FIG. 3.

FIG. 4 illustrates a cross section of the vacuum cleaner 1 illustrated in FIG. 3. In FIG. 4, the cross section is made through the central elongation axis Eax illustrated in FIG. 3 in a direction coinciding with the viewing direction of FIG. 3. As can be seen in FIG. 4, according to the illustrated embodiments, the vacuum cleaner 1 comprises two separate air outlets 9, 9' arranged on the elongated body 3. However, according to further embodiments, the vacuum cleaner 1 may comprise one air outlet or more than two air outlets 9, 9'. The vacuum cleaner 1 further comprises a dust separation unit 15 arranged inside the elongated body 3. According to the illustrated embodiments, the dust separation unit 15 comprises a cyclone separator. As an alternative, or in addition, the dust separation unit 15 may comprise another type of dust separation unit, such as a dust bag, or the like. As can be seen in FIG. 4, according to embodiments herein, the vacuum cleaner 1 comprises a first motor/fan unit 11 and a second motor/fan unit 12 each arranged inside the elongated body 3. Each of the first and second motor/fan unit 11, 12 comprises a fan 17, 17' and an electric motor 19, 19' configured to power the fan 17, 17'.

The vacuum cleaner 1 comprises a duct assembly 16 configured to conduct air from the air inlet 7 through the dust separation unit 15 to the at least one air outlet 9, 9'. As can be seen in FIG. 4, the first and second motor/fan units 11, 12 are arranged in parallel relative to each other in the duct assembly 16. The first and second motor/fan units 11, 12 are thus arranged to operate in parallel to generate an airflow from the air inlet 7 through the dust separation unit 15 to the at least one air outlet 9, 9'.

Due to these features, a vacuum cleaner 1 is provided having conditions for a significantly widened operational range in which the vacuum cleaner 1 can be operated in an efficient manner, as is further explained herein. This is because the airflows and partial vacuums of the first and second motor/fan units 11, 12 are combined due to the parallel arrangement of the first and second motor/fan units 11, 12 in the duct assembly 16. Moreover, a vacuum cleaner 1 is provided having conditions for generating higher airflow levels through the air inlet 7 which provides conditions for an improved cleaning efficiency.

The feature that the first and second motor/fan units 11, 12 are arranged to operate in parallel to generate an airflow from the air inlet 7 through the dust separation unit 15 means that each of the first and second motor/fan units 11, 12 is arranged to pump air through the dust separation unit 15 via a flow path which does not pass through the other motor/fan unit 11, 12. Likewise, the feature that the first and second motor/fan units 11, 12 are arranged in parallel relative to each other in the duct assembly 16 means that each of the first and second motor/fan units 11, 12 is arranged to pump air through the dust separation unit 15 via a flow path which does not pass through the other motor/fan unit 11, 12. Moreover, each of the first and second motor/fan units 11, 12 may have an air inlet fluidly connected to the dust separation unit 15 via a flow path which does not pass through the other motor/fan unit 11, 12.

According to the embodiments illustrated in FIG. 3 and FIG. 4, the second motor/fan unit 12 is arranged at a greater distance d2 from the nozzle end 4 than the first motor/fan unit 11. In other words, the first motor/fan unit 11 is arranged at a first distance d1 from the nozzle end 4 and the second motor/fan unit 12 is arranged at a second distance d2 from the nozzle end 4, wherein the second distance d2 is greater than the first distance d1. According to the illustrated embodiments, the second distance d2 is approximately 77% greater than the first distance d1, i.e. the second distance d2 is approximately 1.77 times the first distance d1. According to further embodiments, the second distance d2 may be within the range of 1.05-5 times the first distance d1, or may be within the range of 1.4-2.3 times the first distance d1. Moreover, as seen in FIG. 4, according to these embodiments, the first and second motor/fan unit 11, 12 are arranged inside the elongated body 3 such that the central elongation axis Eax of the elongated body 3 extends through each of the first and second motor/fan unit 11, 12. In other words, one of the first and second motor/fan units 11, 12 is arranged behind the other of the first and second motor/fan units 11, 12 seen along the central elongation axis Eax of the elongated body 3. Due to these features, a vacuum cleaner 1 is provided having conditions for a slimmer design and better weight distribution of the components of the vacuum cleaner 1.

As seen in FIG. 4, according to these embodiments, the duct assembly 16 comprises a first duct section 16' fluidly connecting an inlet of the first motor/fan unit 11 and the dust separation unit 15 and a second duct section 16" fluidly connecting an inlet of the second motor/fan unit 12 and the dust separation unit 15, wherein the second duct section 16" is separate from the first duct section 16' and is arranged in parallel to the first duct section 16'. Since the vacuum cleaner 1 according to the illustrated embodiments comprises two motor/fan units 11, 12 arranged to operate in parallel to generate an airflow through a dust separation unit 15 comprising a cyclone separator, the dust separation efficiency of the cyclone separator can be improved. This is because the arrangement with two motor/fan units 11, 12 operating in parallel is capable of generating higher airflow rates through the cyclone separator in an efficient manner as compared to the use of one motor/fan unit. A cyclone separator usually has a relative high flow resistance causing a relative high pressure drop during operation of a vacuum cleaner. However, since the vacuum cleaner 1 comprises two motor/fan units 11, 12 configured to operate in parallel, conditions are provided for generating high airflow levels through the cyclone separator of the dust separation unit 15. According to the illustrated embodiments, the vacuum cleaner 1 comprises a filter 22 arranged between the dust separation unit 15 and the first and second motor/fan units 11, 12. The filter 22 is configured to further separate fine particles from air flowing towards the first and second motor/fan units 11, 12. The filter 22 may comprise a semi-permeable material, such as a foam and/or a textile material.

Also according to these embodiments, the first and second motor/fan unit 11, 12 may be differently configured. The first and second motor/fan unit 11, 12 may be differently configured regarding type and/or size of the electric motor 19, 19'. As an alternative, or in addition, the first and second motor/fan unit 11, 12 may be differently configured regarding type and/or size of the fan 17, 17'. As a further alternative, or in addition, the second motor/fan unit 9' may be differently configured than the first motor/fan unit 9 regarding working point. The working points of the first and second first motor/fan unit 9, 9' may be defined as the airflow rate generated at the highest ratio between suction power and inputted electrical energy. The suction power may be defined as the flowrate times pressure difference generated.

According to the embodiments illustrated in FIG. 3 and FIG. 4, each of the first and second motor/fan unit 11, 12 comprises a brushless electric motor 19, 19' configured to power the fan 17, 17'. According to further embodiments, at least one of the first and second motor/fan unit 11, 12 comprises a brushless electric motor 19, 19' configured to power the fan 17, 17'. Due to these features, a vacuum cleaner 1 is provided having conditions for a further widened operational range in which the vacuum cleaner 1 can be operated in an efficient manner. Moreover, a vacuum cleaner 1 is provided having conditions for generating high airflow rates at the air inlet 7. This is because a motor/fan unit 11, 12 comprising a brushless motor usually has the ability to generate high vacuum levels through high rotational speeds.

The vacuum cleaner 1 comprises a control arrangement 21. The control unit 21 is configured to control operation of the first and second motor/fan unit 11, 12. Moreover, according to the illustrated embodiments, the vacuum cleaner 1 comprises a battery assembly 23. The battery assembly 23 may comprise a number of rechargeable battery cells. The battery assembly 23 is configured to supply electricity to each of the first and second motor/fan unit 11, 12 by an amount controlled by the control unit 21. Thus, according to the illustrated embodiments, the first and second motor/fan unit 11, 12 are powered by a common power supply, i.e. the battery assembly 23 according to the illustrated embodiments.

According to some embodiments, the control arrangement 21 is configured to operate the first and second motor/fan unit 11, 12 in a mode in which the first and second motor/fan unit 11, 12 are operated at different power levels. Thereby, conditions are provided for further widening the operational range in which the vacuum cleaner 1 can be operated in an efficient manner in order to provide high cleaning efficiency while consuming a low amount of electrical energy.

As best seen in FIG. 3, according to the illustrated embodiments, the vacuum cleaner 1 comprises a user interface 40 comprising two buttons 41, 42. According to further embodiments, the user interface 40 may comprise one or more other types of input devices, such as a switch, a knob, a touch sensitive screen, or the like. The buttons 41, 42 of the user interface 40 is operably connected to the control unit 21 for allowing a user to activate and deactivate operation of the first and second motor/fan unit 11, 12. Moreover, the user interface 40 of the vacuum cleaner 1 may allow a user to select an operational mode of the vacuum cleaner 1, wherein the operational modes of the vacuum cleaner 1 may comprise one or more of a mode in which the first and second motor/fan unit 11, 12 are simultaneously operated at the same power level, a mode in which the first and second motor/fan unit 11, 12 are simultaneously operated at different power levels, and a mode in which only one of the first and second motor/fan unit 11, 12 is operated.

The vacuum cleaner 1 may comprise a one way valve, or other type of arrangement in the duct assembly 16, for preventing a reverse flow of air over the inactive motor/fan unit 11, 12 when the vacuum cleaner 1 is operating in an operational mode in which only one of the first and second motor/fan unit 11, 12 is operated.

As mentioned above, according to the embodiments illustrated in FIG. 3 and FIG. 4, the vacuum cleaner 1 comprises two separate air outlets 9, 9' arranged on the elongated body 3. In more detail, according to the embodiments illustrated in FIG. 3 and FIG. 4, the duct assembly 16 comprises a first section 25 fluidly connecting an air outlet of the first motor/fan unit 11 and a first air outlet 9 of the vacuum cleaner 1. Moreover, the duct assembly 16 comprises a second section 26 fluidly connecting an air outlet of the second motor/fan unit 12 and a second air outlet 9' of the vacuum cleaner 1, wherein the second section 26 of the duct assembly 16 is separate from the first section 25. Thus, according to the embodiments illustrated in FIG. 3 and FIG. 4, the vacuum cleaner 1 comprises two separate flow paths downstream of the respective first and second motor/fan units 11, 12 each extending to a respective air outlet 9, 9'. However, according to further embodiments, the vacuum cleaner 1 1 may comprise a common flow path downstream of the first and second motor/fan units 11, 12, as the vacuum cleaner 1 according to the embodiments illustrated in FIG. 2.

As indicated in FIG. 4, according to these embodiments, the first section 25 of the duct assembly 16 is in thermal communication with the battery assembly 23. According to the illustrated embodiments, the first section 25 is in thermal communication with the battery assembly 23 by extending past the battery assembly 23. In embodiments in which the vacuum cleaner 1 is operable in an operational mode in which only one of the first and second motor/fan unit 11, 12 is operated, the control arrangement 21 may be configured to operate only the first motor/fan unit 11 and render the second motor/fan unit 12 inoperable when operating in such a mode. In this manner, an efficient cooling of the battery assembly 23 is provided during operation of the vacuum cleaner 1. Moreover, according to the embodiments illustrated in FIG. 4, the control unit 21 is arranged in the first section 25 of the duct assembly 16. In this manner, an efficient cooling of the control unit 21 is provided during operation of the vacuum cleaner 1.

In FIG. 4, a respective rotation axis ax1, ax2 of the first and second motor/fan units 11, 12 are indicated. A rotor of the electric motor 19 of the first motor/fan unit 11 and the fan 17 of the first motor/fan unit 11 are configured to rotate around the rotation axis ax1 of the first motor/fan unit 11 during operation of the first motor/fan unit 11. Likewise, a rotor of the electric motor 19' of the second motor/fan unit 12 and the fan 17' of the second motor/fan unit 12 are configured to rotate around the rotation axis ax2 of the second motor/fan unit 12 during operation of the second motor/fan unit 12. According to the embodiments illustrated in FIG. 4, the rotation axis ax2 of the second motor/fan unit 12 is parallel to the rotation axis ax1 of the first motor/fan unit 11. According to further embodiments, the rotation axis ax2 of the second motor/fan unit 12 may be substantially parallel to the rotation axis ax1 of the first motor/fan unit 11. The feature that the rotation axis ax2 of the second motor/fan unit 12 is substantially parallel to the rotation axis ax1 of the first motor/fan unit 11 may encompass that the angle between the rotation axis ax1 of the first motor/fan unit 11 and the rotation axis ax2 of the second motor/fan unit 12 is less than 10 degrees, or less than 5 degrees.

According to the illustrated embodiments, the rotation axes ax1, ax2 the first and second motor/fan units 11, 12 are parallel to the central elongation axis Eax of the elongated body 3. According to further embodiments, the rotation axes ax1, ax2 the first and second motor/fan units 11, 12 may be substantially parallel to the central elongation axis Eax of the elongated body 3. The feature that the rotation axes ax1, ax2 the first and second motor/fan units 11, 12 is substantially parallel to the central elongation axis Eax may encompass that the angle between the respective rotation axis ax1, ax2 and the central elongation axis Eax of the elongated body 3 is less than 10 degrees, or less than 5 degrees. Due to these features, conditions are provided for a slim design of the elongated body 3 due to conditions for a space efficient routing of ducts forming the duct assembly 16 of the vacuum cleaner 1.

Figure 5:
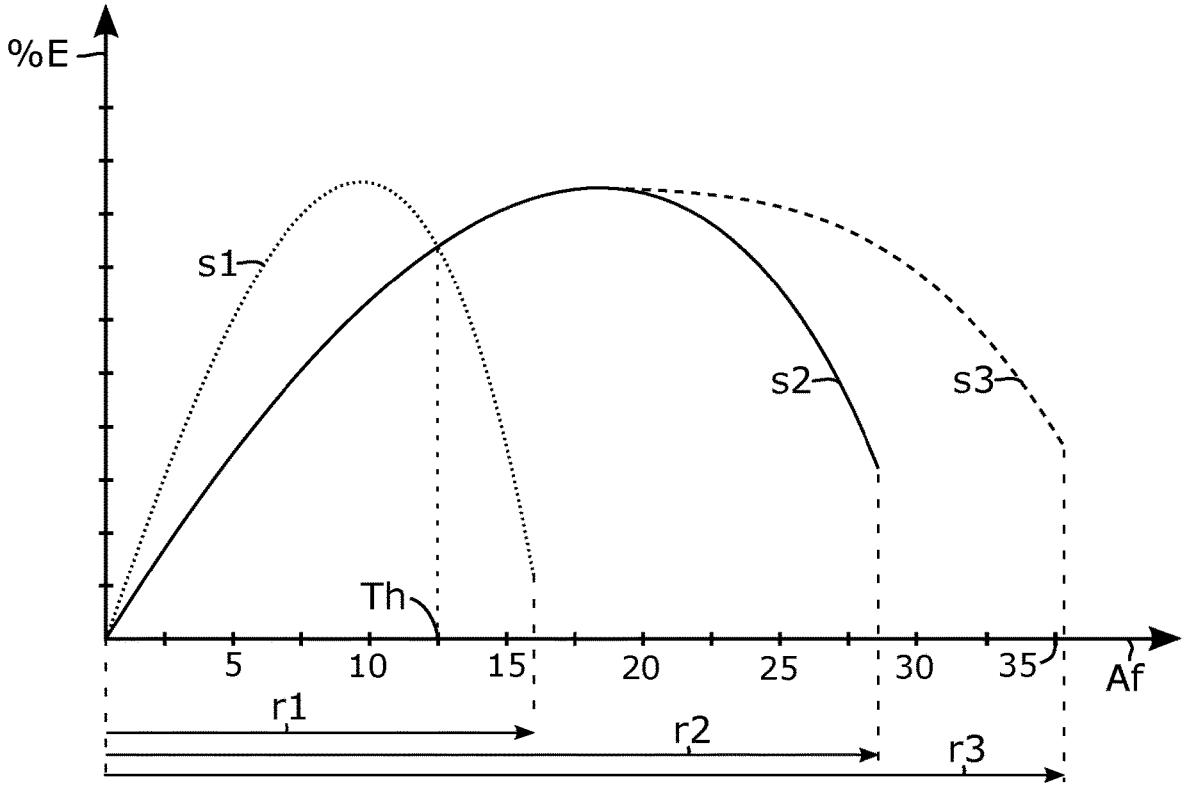
FIG. 5 illustrates a graph showing the correlation between the airflow rate and the energy efficiency of the vacuum cleaner according to some embodiments explained with reference to FIG. 1-FIG. 4.

FIG. 5 illustrates a graph showing the correlation between the airflow rate Af and the energy efficiency E of the vacuum cleaner 1 according to some embodiments explained with reference to FIG. 1-FIG. 4. Below, simultaneous reference is made to FIG. 1-FIG. 5. The x-axis of the graph in FIG. 5 shows the airflow rate Af in litres per second at the air inlet 7 of the vacuum cleaner 1. The y-axis of the graph in FIG. 5 shows the energy efficiency E of the vacuum cleaner 1 in percentage. The energy efficiency E of the vacuum cleaner 1 is herein defined as the ratio between the useful output in the form of suction power at the air inlet 7 of the vacuum cleaner 1 and the input of electrical energy.

The dotted line provided with the reference sign s1 indicates the airflow rate Af and energy efficiency E when the vacuum cleaner 1 is operating in a mode in which only one of the first and second motor/fan units 11, 12 is operated and the other of the first and second motor/fan units 11, 12 is rendered inoperable. This operational mode is below referred to as the non-cooperative mode. The dotted line provided with the reference sign s1 in FIG. 5 corresponds to an airflow rate Af and energy efficiency E of a prior art vacuum cleaner comprising one motor/fan unit only. The lines in FIG. 5 indicates at least partially unrestricted operation, i.e. operation where the dust separation unit 15, filters 22, and the air inlet 7 of the vacuum cleaner 1 are not clogged or restricted.

As can be seen in FIG. 5, the vacuum cleaner 1 has a relative high energy efficiency in a lower operational range r1 at approximately 5 and 12.5 litres per second when operating in the non-cooperative mode. However, the vacuum cleaner 1 has a relative narrow operational range r1 regarding the possible airflow rate Af.

The full line provided with the reference sign s2 in FIG. 5 indicates the airflow rate Af and energy efficiency E of a vacuum cleaner 1 explained with reference to FIG. 1-FIG. 4 operating in an operational mode in which the first and second motor/fan unit 11, 12 are simultaneously operated at the same power level, wherein the vacuum cleaner 1 comprises a first and second motor/fan unit 11, 12 of identical design.

The dashed line provided with the reference sign s3 indicates the airflow rate Af and energy efficiency E a vacuum cleaner 1 explained with reference to FIG. 1-FIG. 4 operating in an operational mode in which the first and second motor/fan unit 11, 12 are simultaneously operated at the same power level, wherein the vacuum cleaner 1 comprises a first and second motor/fan unit 11, 12 having different working points. The different working points of the first and second motor/fan units 11, 12 may be obtained by providing the first and second motor/fan units 11, 12 with different types of motors 19, 19', and or by providing the first and second motor/fan units 11, 12 with different types of fans 17, 17', such as different sizes, different number of blades, different blade angles, and the like. An operational mode in which the first and second motor/fan units 11, 12 are simultaneously operated is in some places below referred to as a cooperative cleaning mode.

As can be seen from the full line s2, the vacuum cleaner 1 comprising a first and second motor/fan unit 11, 12 of identical design has a significantly higher output capacity and a wider operational range r2 regarding airflow rate Af when operating in the cooperative cleaning mode than a prior art vacuum cleaner comprising one motor/fan unit only. Moreover, the vacuum cleaner 1 has a significantly greater energy efficiency E at higher output levels than prior art vacuum cleaner comprising one motor/fan unit only.

Likewise, as can be seen from the dashed line s3, the vacuum cleaner 1 comprising a first and second motor/fan unit 11, 12 having different working points has a significantly higher output capacity and a wider operational range r3 regarding airflow rate Af when operating in the cooperative cleaning mode than the vacuum cleaner 1 comprising a first and second motor/fan unit 11, 12 of identical design (the full line). Moreover, the vacuum cleaner 1 comprising a first and second motor/fan unit 11, 12 having different working points has a greater energy efficiency E at higher output levels than prior art vacuum cleaner comprising one motor/fan unit only. In addition, the vacuum cleaner 1 comprising a first and second motor/fan unit 11, 12 having different working points has a significantly greater energy efficiency E at higher output levels, i.e. above approximately 18 litres per second in the illustrated example, than the vacuum cleaner 1 comprising a first and second motor/fan unit 11, 12 of identical design (the full line). A similar result as the dashed line s3 may be obtained by operating the vacuum cleaner 1 in an operational mode in which the first and second motor/fan unit 11, 12 are simultaneously operated at the different power levels.

According to embodiments herein, the control arrangement 21 may be configured to operate the vacuum cleaner 1 in the non-cooperative cleaning mode at lower output ranges and may switch to the cooperative cleaning mode when a wanted output reaches a threshold Th. In this manner, the energy efficiency E of the vacuum cleaner 1 can be maximized. In the illustrated example, the threshold Th is set to approximately 12.5 litres per second. This is because in the illustrated example, the vacuum cleaner 1 has a greater energy efficiency E at airflow rates below 12.5 litres per second when operating in the non-cooperative cleaning mode whereas the vacuum cleaner 1 has a greater energy efficiency E at airflow rates above 12.5 litres per second when operating in the cooperative cleaning mode. Thus, by switching between the non-cooperative cleaning mode and the cooperative cleaning mode based on a wanted output level, the energy efficiency E of the vacuum cleaner 1 can be maximized. As understood from the persons skilled in the art, the threshold Th may be set to another value depending on the design of the vacuum cleaner 1.

Figure 6:
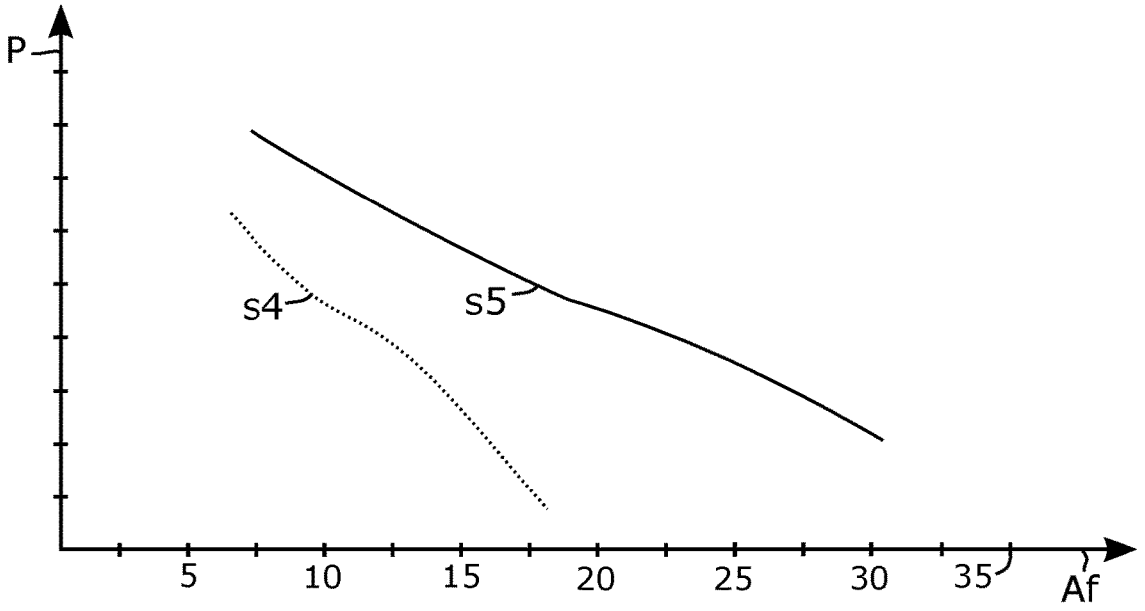
FIG. 6 illustrates a graph showing the correlation between the airflow rate and the pressure difference generated by the vacuum cleaner according to some embodiments explained with reference to FIG. 1-FIG. 5.

FIG. 6 illustrates a graph showing the correlation between the airflow rate Af and the pressure difference P generated by the vacuum cleaner 1 according to some embodiments explained with reference to FIG. 1-FIG. 5. Below, simultaneous reference is made to FIG. 1-FIG. 6. The x-axis of the graph in FIG. 6 shows the airflow rate Af in litres per second at the air inlet 7 of the vacuum cleaner 1. The y-axis of the graph in FIG. 6 shows the pressure difference P generated by the vacuum cleaner 1 in kPa. The pressure difference P may be defined as the difference between a current ambient air pressure and a current pressure in a portion of the duct assembly 16 upstream of the first and second motor/fan units 11, 12.

The dotted line provided with the reference sign s4 indicates the airflow rate Af and the pressure difference P generated by the vacuum cleaner 1 when the vacuum cleaner 1 is operating in a mode in which only one of the first and second motor/fan units 11, 12 is operated and the other of the first and second motor/fan units 11, 12 is rendered inoperable, i.e. when the vacuum cleaner 1 is operating in the non-cooperative mode referred to above. The dotted line provided with the reference sign s4 in FIG. 6 corresponds to an airflow rate Af and pressure difference P generated by a prior art vacuum cleaner comprising one motor/fan unit only. The full line provided with the reference sign s5 in FIG. 6 indicates the airflow rate Af and the pressure difference P generated by a vacuum cleaner 1 explained with reference to FIG. 1-FIG. 5 operating in an operational mode in which the first and second motor/fan unit 11, 12 are simultaneously operated.

As can be seen in the graph illustrated in FIG. 6, significantly higher pressure difference levels P can be obtained in a significantly wider operational range when the first and second motor/fan unit 11, 12 are simultaneously operated (full line s5) as compared to when only one of the first and second motor/fan units 11, 12 is operated (dotted line s4). Accordingly, since the vacuum cleaner 1 comprises two motor/fan units 11, 12 arranged to operate in parallel, a vacuum cleaner 1 is provided having conditions for generating high pressure difference levels also in situations of high pressure drops in the vacuum cleaner 1, such as for example when the dust separation unit 15 and/or a filter 22 of the vacuum cleaner 1 is/are partially clogged. Thus, as a result of these features, conditions are provided for a high cleaning efficiency also if the dust separation unit 15 and/or a filter 22 of the vacuum cleaner 1 is/are partially clogged. Moreover, since the vacuum cleaner 1 comprises two motor/fan units 11, 12 having conditions for generating high pressure difference levels P over a wider operational range, conditions are provided for using thicker and/or denser noise attenuating materials in the duct assembly 16 of the vacuum cleaner 1 and still be able to generate high air flow levels through the air inlet 7 of the vacuum cleaner 1.

The control arrangement 21, as referred to herein, may comprise a calculation unit which may take the form of substantially any suitable type of processor circuit or microcomputer, e.g. a circuit for digital signal processing (digital signal processor, DSP), a Central Processing Unit (CPU), a processing unit, a processing circuit, a processor, an Application Specific Integrated Circuit (ASIC), a microprocessor, or other processing logic that may interpret and execute instructions. The herein utilised expression "calculation unit" may represent a processing circuitry comprising a plurality of processing circuits, such as, e.g., any, some or all of the ones mentioned above.

The control arrangement 21 may further comprise a memory unit, wherein the calculation unit may be connected to the memory unit, which may provide the calculation unit with, for example, stored program code and/or stored data which the calculation unit may need to enable it to do calculations. The calculation unit may also be adapted to store partial or final results of calculations in the memory unit. The memory unit may comprise a physical device utilised to store data or programs, i.e., sequences of instructions, on a temporary or permanent basis. According to some embodiments, the memory unit may comprise integrated circuits comprising silicon-based transistors. The memory unit may comprise e.g. a memory card, a flash memory, a USB memory, a hard disc, or another similar volatile or non-volatile storage unit for storing data such as e.g. ROM (Read-Only Memory), PROM (Programmable Read-Only Memory), EPROM (Erasable PROM), EEPROM (Electrically Erasable PROM), etc. in different embodiments.

The control arrangement 21 may be connected to components of the vacuum cleaner 1 for receiving and/or sending input and output signals. These input and output signals may comprise waveforms, pulses, or other attributes which the input signal receiving devices can detect as information and which can be converted to signals processable by the control arrangement 21. These signals may then be supplied to a calculation unit of the vacuum cleaner 1. Each of the connections to the respective components of the vacuum cleaner 1 for receiving and sending input and output signals may take the form of a cable.

In the embodiments illustrated, the vacuum cleaner 1 comprises one control arrangement 21 but might alternatively be implemented wholly or partly in two or more control units.

It is to be understood that the foregoing is illustrative of various example embodiments and that the invention is defined only by the appended independent claims. A person skilled in the art will realize that the example embodiments may be modified, and that different features of the example embodiments may be combined to create embodiments other than those described herein, without departing from the scope of the present invention, as defined by the appended independent claims.

As used herein, the term "comprising" or "comprises" is open-ended, and includes one or more stated features, elements, steps, components, or functions but does not preclude the presence or addition of one or more other features, elements, steps, components, functions, or groups thereof.

The invention claimed is:

1. A vacuum cleaner comprising:

an elongated body having a nozzle end and a handle end, an air inlet arranged at the nozzle end, a handle arranged at the handle end, at least one air outlet arranged on the elongated body, a dust separation unit arranged inside the elongated body, and a first motor/fan unit and a second motor/fan unit each arranged inside the elongated body, wherein the first motor/fan unit and the second motor/fan unit are arranged to operate in parallel to generate an airflow from the air inlet through the dust separation unit to the at least one air outlet and the first motor/fan unit has a different efficient working point from the second motor/fan unit.

2. The vacuum cleaner according to claim 1, wherein the dust separation unit comprises a cyclone separator.

3. The vacuum cleaner according to claim 1, wherein the first motor/fan unit is different from the second motor/fan unit with regard to structural aspects.

4. The vacuum cleaner according to claim 3, wherein each of the first motor/fan unit and the second motor/fan unit comprises a respective fan and a respective electric motor configured to power the respective fan, and wherein the first motor/fan unit and the second motor/fan unit are differently configured regarding a type and/or a size of the respective electric motor.

5. The vacuum cleaner according to claim 3, wherein each of the first motor/fan unit and the second motor/fan unit comprises a respective fan and a respective electric motor configured to power the respective fan, and wherein the first motor/fan unit and the second motor/fan unit are differently configured regarding a type and/or a size of the respective fan.

6. The vacuum cleaner according to claim 1, wherein at least one of the first motor/fan unit and the second motor/fan unit comprises a fan and a brushless electric motor configured to power the fan.

7. The vacuum cleaner according to claim 1, wherein each of the first motor/fan unit and the second motor/fan unit comprises a respective fan and a respective brushless electric motor configured to power the respective fan.

8. The vacuum cleaner according to claim 1, wherein the vacuum cleaner comprises a control arrangement configured to control operation of the first motor/fan unit and the second motor/fan unit, and wherein the control arrangement is configured to operate the first motor/fan unit and the second motor/fan unit in a mode in which the first motor/fan unit and the second motor/fan unit are operated at different respective power levels.

9. The vacuum cleaner according to claim 1, wherein the second motor/fan unit is arranged at a greater distance from the nozzle end than the first motor/fan unit.

10. The vacuum cleaner according to claim 1, wherein the first motor/fan unit and the second motor/fan unit are arranged inside the elongated body such that a central elongation axis of the elongated body extends through each of the first motor/fan unit and the second motor/fan unit.

11. The vacuum cleaner according to claim 1, wherein the second motor/fan unit comprises a respective rotation axis that is substantially parallel to a respective rotation axis of the first motor/fan unit.

12. The vacuum cleaner according to claim 1, wherein the vacuum cleaner comprises a battery assembly configured to supply electricity to the first motor/fan unit and the second motor/fan unit.

13. The vacuum cleaner according to claim 12, wherein the vacuum cleaner comprises a duct assembly configured to conduct air from the air inlet through the dust separation unit to the at least one air outlet, and wherein the duct assembly comprises a section in thermal communication with the battery assembly.

14. The vacuum cleaner according to claim 13, wherein the section is arranged downstream of the first motor/fan unit and the second motor/fan unit.

15. The vacuum cleaner according to claim 1, wherein the vacuum cleaner comprises two separate air outlets arranged on the elongated body.

16. The vacuum cleaner according to claim 1, wherein the vacuum cleaner is configured for floor cleaning.

17. A vacuum cleaner comprising:

an elongated body having a nozzle end and a handle end;

an air inlet arranged at the nozzle end;

a handle arranged at the handle end;

at least one air outlet arranged on the elongated body;

a dust separation unit arranged inside the elongated body; and a first motor and fan unit and a second motor and fan unit each arranged inside the elongated body, wherein the first motor and fan unit and the second motor and fan unit are arranged to operate in parallel to generate an airflow from the air inlet through the dust separation unit to the at least one air outlet and the second motor and fan unit is arranged at a greater distance from the nozzle end than the first motor and fan unit.

18. The vacuum cleaner of claim 17, wherein the first motor and fan unit has a different efficient working point from the second motor and fan unit.

19. A vacuum cleaner comprising:

an elongated body having a nozzle end and a handle end;

an air inlet arranged at the nozzle end;

a handle arranged at the handle end;

at least one air outlet arranged on the elongated body;

a dust separation unit arranged inside the elongated body; and a first motor and fan unit and a second motor and fan unit each arranged inside the elongated body, wherein the first motor and fan unit and the second motor and fan unit are arranged to operate in parallel to generate an airflow from the air inlet through the dust separation unit to the at least one air outlet, and wherein the first motor and fan unit comprises a first electric motor, the second motor and fan unit comprises a second electric motor, and the first electric motor is of a different type and/or size from the second electric motor.

20. The vacuum cleaner of claim 19, wherein the first motor and fan unit further comprises a first fan, the second motor and fan unit further comprises a second fan, and the first fan is of a different type and/or size from the second fan.

* * * * *